US009662760B2

(12) United States Patent
Schuele et al.

(10) Patent No.: US 9,662,760 B2
(45) Date of Patent: May 30, 2017

(54) HAND-HELD POWER TOOL HAVING AN ELECTRONICALLY COMMUTATED ELECTRIC MOTOR AND AN INTEGRATED ELECTRONICS SYSTEM

(71) Applicant: Robert Bosch GmbH, Stuttgart (DE)

(72) Inventors: Manfred Schuele, Sulzbach-Laufen (DE); Helmut Wanek, Kirchheim/Neckar (DE); Cornelius Boeck, Kirchheim (DE); Daniel Barth, Leinfelden-Echterdingen (DE); Joachim Schadow, Stuttgart (DE); Joerg Maute, Sindelfingen (DE); Florian Esenwein, Leinfelden-Echterdingen (DE); Manfred Lutz, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 186 days.

(21) Appl. No.: 14/651,261

(22) PCT Filed: Dec. 9, 2013

(86) PCT No.: PCT/EP2013/075914

§ 371 (c)(1),
(2) Date: Jun. 11, 2015

(87) PCT Pub. No.: WO2014/095449

PCT Pub. Date: Jun. 26, 2014

(65) Prior Publication Data

US 2015/0328742 A1 Nov. 19, 2015

(30) Foreign Application Priority Data

Dec. 20, 2012 (DE) ..... 10 2012 223 969

(51) Int. Cl.
*B24B 23/02* (2006.01)
*B25F 5/00* (2006.01)

(52) U.S. Cl.
CPC ..... *B24B 23/028* (2013.01); *B25F 5/00* (2013.01)

(58) Field of Classification Search
CPC ..... B24B 23/028; B25F 5/00
See application file for complete search history.

(56) References Cited

U.S. PATENT DOCUMENTS 6,320,286 B1 * 11/2001 Ramarathnam ..... H02K 11/33 310/47
6,688,958 B1 * 2/2004 Jones ..... B24D 15/00 451/345

(Continued)

FOREIGN PATENT DOCUMENTS

CN 201009150 Y 1/2008
CN 201030495 Y 3/2008

(Continued)

OTHER PUBLICATIONS

International Search Report corresponding to PCT Application No. PCT/EP2013/075914, mailed Mar. 25, 2014 (German and English language document) (5 pages).

*Primary Examiner* — George Nguyen
(74) *Attorney, Agent, or Firm* — Maginot, Moore & Beck LLP

(57) ABSTRACT

A hand-held power tool, in particular an angle grinder, having a drive unit, has an electronically commutated electric motor and has an electronics system which is integrated in an appliance housing. The ratio of a weight of the hand-held power tool $M_{HWZM}$ to a nominal power $P_N$ is selected in such a way that, in a power range of from 0 to 1200 W, the ratio of the weight of the hand-held power tool $M_{HWXM}$ to the nominal power $P_N$ is at most 0.75 g/W*$P_N$+1200 g, and, at a value of the nominal power of (Continued)

greater than 1200 W, the ratio of the weight of the hand-held power tool to the nominal power is at most $2.2*P_N-540$ g.

20 Claims, 8 Drawing Sheets

(56) References Cited

U.S. PATENT DOCUMENTS

| | | | | |
|---|---|---|---|---|
| 8,113,921 | B2 * | 2/2012 | Krauss | B24B 23/03 451/350 |
| 9,421,663 | B2 * | 8/2016 | Thomaschewski | B24B 23/02 |
| 2005/0245183 | A1 | 11/2005 | Deshpande et al. | |
| 2014/0147718 | A1 * | 5/2014 | Furui | H01M 2/1055 429/99 |

FOREIGN PATENT DOCUMENTS

| | | | |
|---|---|---|---|
| CN | 102149515 | A | 8/2011 |
| CN | 202015988 | U | 10/2011 |
| EP | 1 016 504 | A2 | 7/2000 |
| WO | 2010/087235 | A1 | 8/2010 |

* cited by examiner

HAND-HELD POWER TOOL HAVING AN ELECTRONICALLY COMMUTATED ELECTRIC MOTOR AND AN INTEGRATED ELECTRONICS SYSTEM

This application is a 35 U.S.C. §371 National Stage Application of PCT/EP2013/075914, filed on Dec. 9, 2013, which claims the benefit of priority to Serial No. DE 10 2012 223 969.3, filed on Dec. 20, 2012 in Germany, the disclosures of which are incorporated herein by reference in their entirety.

The disclosure relates to a hand-held power tool having an electronically commutated electric motor and an integrated electronics system.

BACKGROUND

Hand-held power tools, in particular angle grinders, having an electronically commutated electric motor and a built-in electronics system, are known from the prior art. Such hand-held power tools are available in a multiplicity of sizes and performance classes. They are often difficult to design because, in particular, the geometric sizes of the components and the masses to be incorporated result in hand-held tools that are ergonomically unfavorable in respect of handling characteristics.

SUMMARY

In comparison with this, hand-held power tools according to the disclosure, having the features described below, have the advantage of an optimally designed ergonomics, handling characteristics and ease of operation.

Advantageously, a motive drive unit has an electronically commutated electric motor. In the case of electronically commutated electric motors, the commutation is effected by means of an electronics system. As a result, electronically commutated electric motors have a longer service life and a higher performance capability than electric motors whose commutation is effected by means of carbon brushes. Dispensing with the carbon brushes has the result that there is little wear on the electronically commutated electric motors.

A particularly ergonomic hand-held power tool is obtained if the ratio of a weight of the hand-held power tool $M_{HWZM}$ to the nominal power $P_N$ is of optimum design. The nominal power is the power consumed by the hand-held power tool in continuous operation and converted in the hand-held power tool. The power output by the hand-held power tool is less, by an efficiency ratio. The nominal power is thus a measure of the performance capability of the hand-held power tool. A weight of the hand-held power tool that is optimum relative to the nominal power has the effect that, in the performance class of the hand-held power tool, working can be performed with little fatigue by an operator. It is advantageous if, in a power range of from 0 to 1200 W, the ratio of the weight of the hand-held power tool $M_{HWZM}$ to the nominal power $P_N$ is maximally 0.75 g/W*$P_N$+1200 g. In the case of powers of greater than 1200 W, the ratio of the weight of the hand-held power tool $M_{HWZM}$ to the nominal power should not exceed 2.2*$P_N$540 g. The hand-held power tool is thus of an optimum ergonomic design.

It is likewise advantageous to select an optimum ratio of a weight of the electronically commutated electric motor $M_{EKM}$ to the nominal power $P_N$. In a power range of between 0 and 600 W, the ratio of the weight of the electronically commutated electric motor $M_{EKM}$ to the nominal power $P_N$ should not be greater than 0.8 g/W. It is particularly advantageous if it is between 0.8 g/W and 0.4 g/W. If the nominal power is greater than 600 W, the ratio of the weight of the electronically commutated electric motor to the nominal power $P_N$ should not exceed 0.3 g/W*$P_N$+300 g. It is particularly advantageous if it is between 0.3 g/W*$P_N$+300 g and 0.15 g/W*$P_N$+150 g. In the said range, dependent on the power, the hand-held power tool is of optimum design in respect of size, weight, and centre of gravity of the electronically commutated electric motor. For the operator, in terms of ergonomic characteristics, this means a high degree of operating comfort.

Furthermore, it is advantageous for a volume of the electronics system to be optimally designed relative to the volume of the electronically commutated electric motor. The ratio of the volume of the electronics system to the volume of the electronically commutated electric motor should be at least 0.7, but maximally 1.6. Ratios of between 0.7 and 1.6 are optimal in respect of performance capability of the hand-held power tool and performance capability of the electronics system that provides electric current to the electronically commutated electric motor.

Ideally, the ratio of the volume of the electronically commutated electric motor to the nominal power does not exceed the value 100 $mm^3$/W. This reduces structural space and material costs.

Advantageously, the hand-held power tool according to the disclosure has an efficiency of between 65% and 97%, but particularly between 65% and 90%. The efficiency is calculated from the quotient of consumed power to power output at the spindle. Within the range, a hand-held power tool that is optimal in respect of performance capability and cost is obtained.

Advantageously, a cooling capacity $P_K$ is a fraction of the nominal power $P_N$, wherein $P_K$=k*$P_N$ and wherein k<0.1. It is particularly advantageous if k<0.075. A powerful and energetically favorable hand-held power tool is thus obtained. With good cooling of the components, the hand-held power tool works efficiently.

If, in a power range of from 0 to 1000 W, the ratio of the diameter of the abrasive disk $d_{Disk}$ to the nominal power $P_N$ is maximally 0.09 mm/W*$P_N$+55 mm, and in the case of greater than 1000 W is maximally 0.2 mm/W*$P_N$−60 mm, the electronics system and/or the electronically commutated electric motor operate/operates in their/its optimum power range. The electronics system is able to supply the required power/the current to the electric-motor drive, but without overheating due to overload.

A further aspect in respect of optimum design of the hand-held power tool 10 consists in a ratio of a diameter of the electronically commutated electric motor 22 $d_{Motor}$ to the diameter of the abrasive disk $d_{Disk}$. Optimally, the diameter $d_{Motor}$ of the electronically commutated electric motor 22≤0.27*$d_{Disk}$+10, but maximally 0.37*$d_{Disk}$+5.

The volume of the electronically commutated electric motor 22 $V_{motor}$ is optimally $V_{motor}$≤0.014*$d_{Disk}^3$+7500. The volume of the electronically commutated electric motor (22) $V_{motor}$ should be maximally 0.019*$d_{Disk}^3$+18000.

Advantageously, the ratio of a diameter of the handle to the nominal power $P_N$ is defined at least by 0.0125 mm/W*$P_N$+25 mm, but maximally by 0.0215 mm/W*$P_N$50 mm. In the respective performance class, the operator is afforded a very good grip on the handle. This makes the hand-held power tool very easy to handle in relation to its nominal power.

The service life and the performance capability of the electric-motor drive can be improved if the electronically commutated electric motor is a brushless electric motor.

Dispensing with the carbon brushes required for commutation has the result that there is little wear on the electronically commutated electric motors.

High performance classes are achieved, advantageously, if the hand-held power tool has a mains power connection line.

It is also advantageous if an appliance housing has a shape other than that of a cylinder. This affords a good grip on the hand-held power tool. Moreover, effective use is made of the structural space for elements such as wiring and electronics.

The said advantages apply, in particular, if the hand-held power tool is realized as an angle grinder.

BRIEF DESCRIPTION OF THE DRAWINGS

Exemplary embodiments of a hand-held power tool according to the disclosure are represented in the drawings. In designing a new hand-held power tool, persons skilled in the art, with knowledge of the parameters essential to the disclosure, and their relationships to each other, will appropriately combine the parameters and ratios, described in the specification, that are relevant to their type of hand-held power tool.

There are shown in.

DETAILED DESCRIPTION

Figure 1:
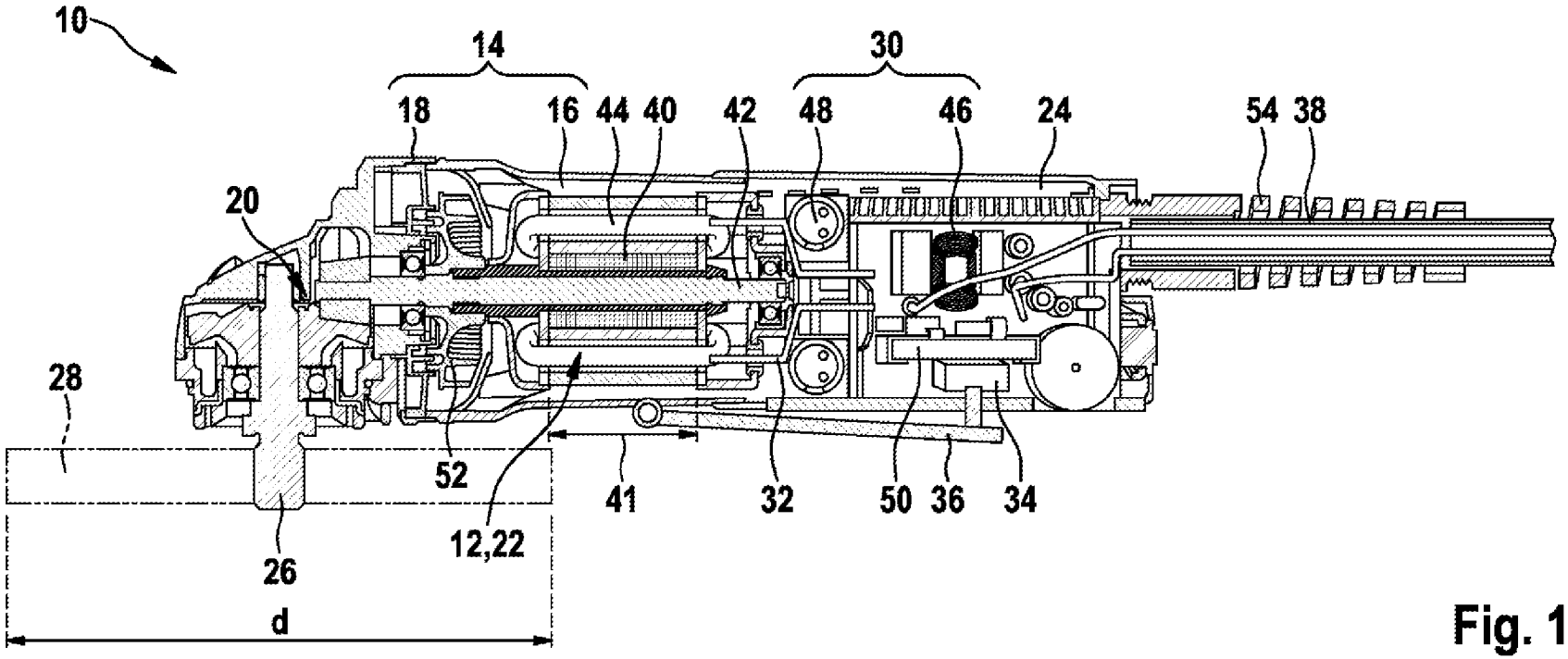
FIG. 1, an exemplary embodiment of a hand-held power tool according to the disclosure, FIG. 2, a first diagram, in which the ratio of a weight of the hand-held power tool to the nominal power is represented, FIG. 3, a second diagram, in which the ratio of a weight of an electronically commutated electric motor to the nominal power is represented, FIG. 4, a third diagram, in which the ratio of a cooling capacity to the nominal power is represented, FIG. 5, a fourth diagram, in which the ratio of a diameter of an abrasive disk to the nominal power is represented, FIG. 6, a fifth diagram, in which the ratio of a volume of the electronically commutated electric motor to the diameter of the abrasive disk is represented, FIG. 7, a sixth diagram, in which the ratio of a diameter of the electronically commutated electric motor to the diameter of the abrasive disk is represented, FIG. 8, a seventh diagram, in which the ratio of a diameter of a handle to the nominal power is represented.

The hand-held power tool 10 on which the disclosure is based is represented as an angle grinder in FIG. 1.

A hand-held power tool 10 of this type has a drive unit 12 and an appliance housing 14. The appliance housing 14 has a motor housing 16 and a transmission housing 18. The transmission housing 18 accommodates a transmission 20, which, in this embodiment, is constituted by a bevel gear transmission. The drive unit 12 includes the transmission 20 and an electronically commutated electric motor 22. The motor housing 16 is realized as a handle 24, and extends in a direction away from the transmission housing 18. In a different design, a handle may also adjoin the motor housing. A spindle 26, to which a working tool 28 can be fixed, projects out of the transmission housing 18. The working tool 28 may be an abrasive disk or a cutting or polishing disk. The working tool 28 is driven in rotation by the electronically commutated electric motor 22, via the transmission 20.

An electronics system 30, for providing electric current to the electronically commutated electric motor 22, is disposed in the transmission housing 14. In the exemplary embodiment, the electronics system 30 is disposed in the motor housing 16. It is also conceivable, however, for the electronics system 30 to be disposed outside of the motor housing 16, such as, for example, in the transmission housing 18 or in its own housing part. Motor lines 32 carry signals from the electronics system 30 to the electronically commutated electric motor 22. A switching element 34, which is located in the motor housing 16, switches the electronically commutated electric motor 22 on and/or off. In the exemplary embodiment in FIG. 1, the switching element 34 is a mechanical switch having a tripping latch 36. Actuation of the switching element 34 causes the drive unit 12 and the electronics system 30 to be provided with electric current by a mechanically closed contact.

Figure 2:
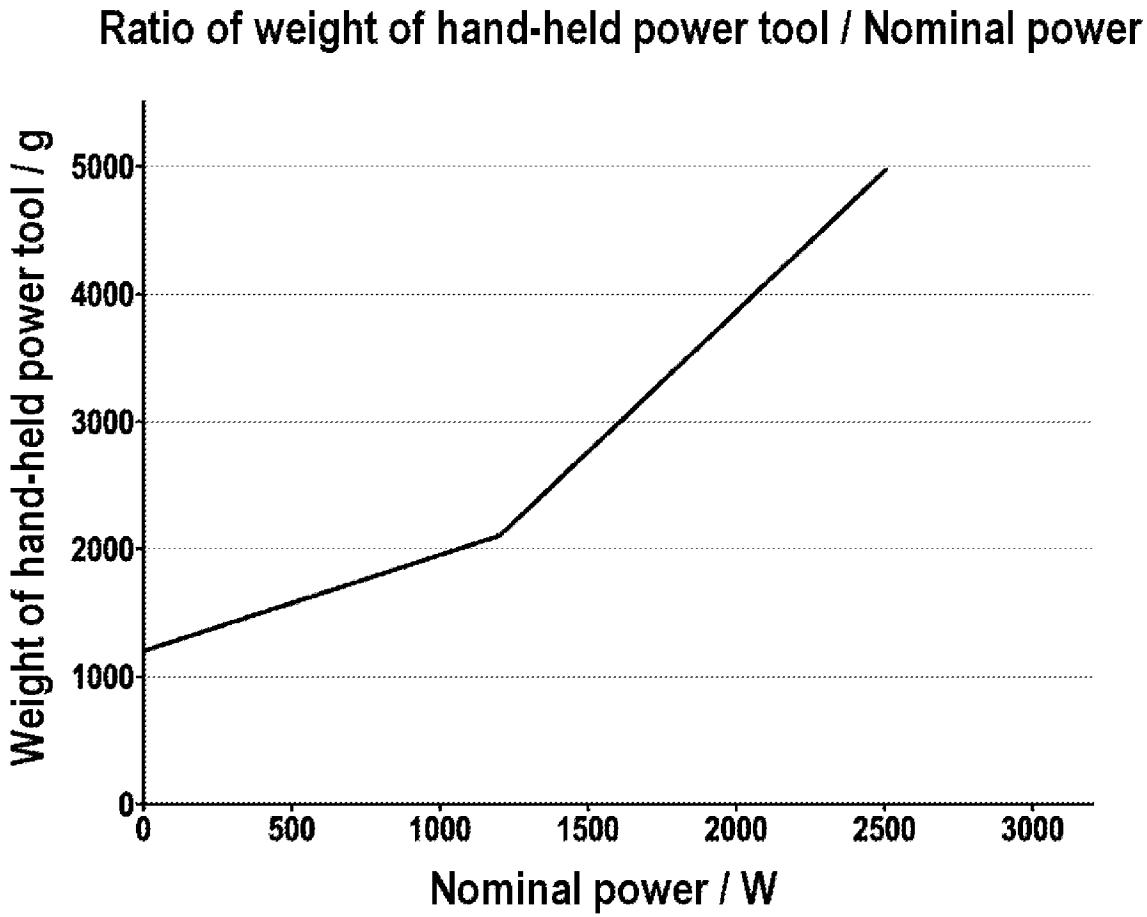

As shown in FIG. 2, an optimum design in respect of handling of the hand-held power tool 10 is achieved in that the ratio of a weight of the hand-held power tool 10 to the nominal power is selected so as to be optimal. In FIG. 2, the weight of the hand-held power tool 10 is shown over the nominal power. The weight of the hand-held power tool 10 results from a total weight of all components of the hand-held power tool 10. It does not include the weights of a mains power supply connection line 38, if present, of the working tool 28, of a protective hood, of any ancillary handle used and/or of other accessories. The efficiency in this case is calculated from the quotient of nominal power to output line at the spindle 28, in percent %. If the weight of the hand-held power tool 10 is too great relative to the nominal power, the hand-held power tool 10 is difficult for an operator to hold in the hand. The result is that the operator rapidly becomes fatigued. An optimum ratio of the weight of the hand-held power tool 10 $M_{HWZM}$ to its nominal power $P_N$ also depends on the power range to which the hand-held power tool 10 belongs. In the case of a nominal power of up to 1200 W, the optimum ratio of the weight of the hand-held power tool 10 $M_{HWZM}$ to its nominal power $P_N$ is maximally $0.75\ g/W*P_N+1200\ g$. In the case of nominal powers of greater than 1200 W, the optimum ratio of the weight of the hand-held power tool 10 to its nominal power is maximally 2.2*PN−540 g. For all ratios that are above the stated ratios, the hand-held power tool 10 becomes too heavy, and therefore too unwieldy.

Figure 3:
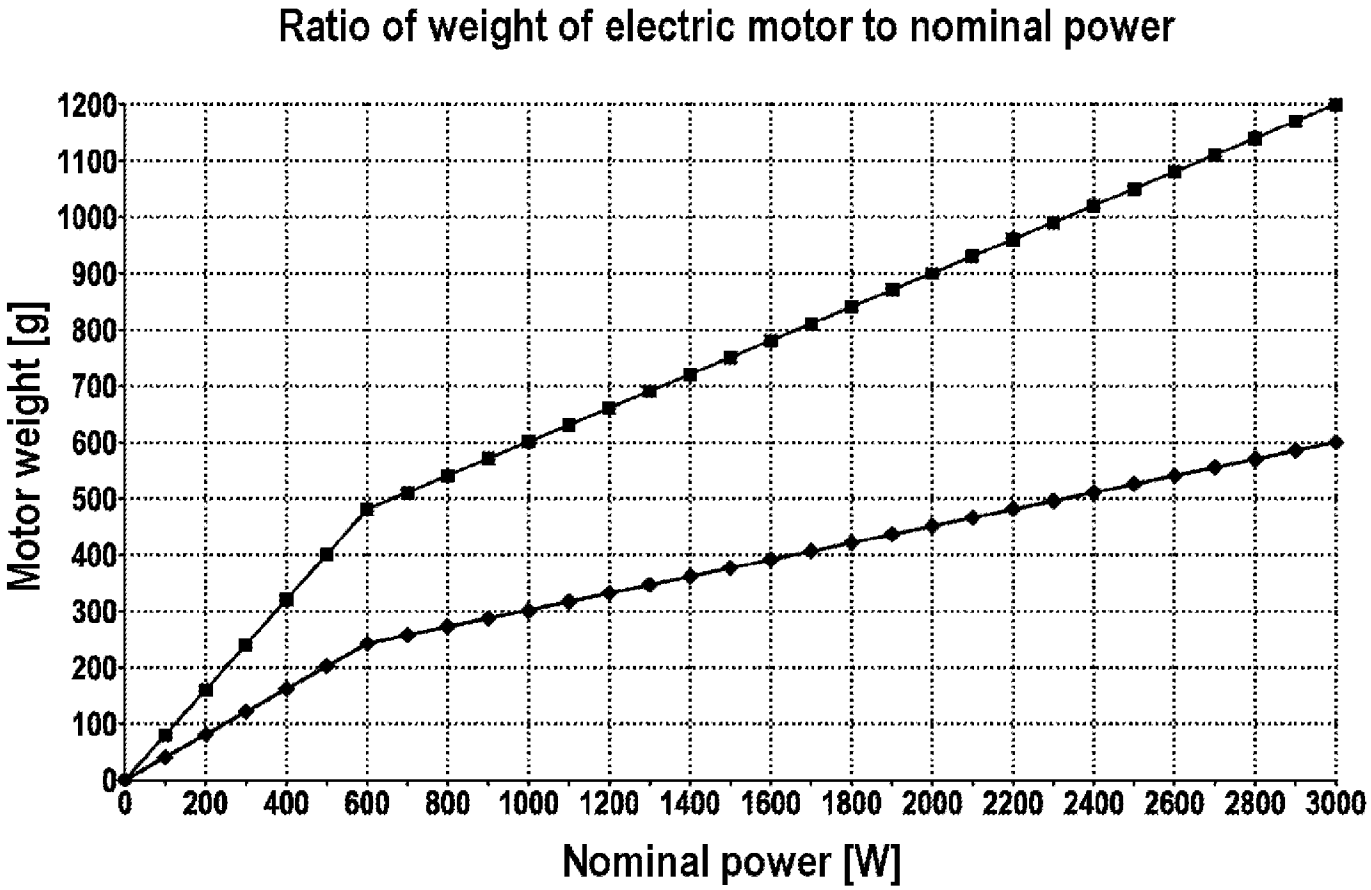

FIG. 3 shows a further optimum design in respect of the handling of the hand-held power tool 10. A weight of the electronically commutated electric motor 22 is represented over the nominal power. It can be seen in this case that a weight of the electronically commutated electric motor 22 $M_{EKM}$ is in an optimum ratio relative to the nominal power $P_N$.

Usually, in the case of electronically commutated electric motors, a rotor 40 contains a rotor packet 41 having permanent magnets. The fixed stator 44 comprises a plurality of coils, which are operated by the electronics system 30 in a time-staggered manner, in order to generate a rotating field. The rotating field causes a torque on the rotor 40, which is permanently excited by the permanent magnets. The rotor 40 is disposed in a rotatable manner in the stator 44. The rotor packet 41 is mounted on a rotor shaft 42.

The weight of the electronically commutated electric motor 22 $M_{EKM}$ results from the weights of the following components, with deviations being possible:

rotor 40 with rotor shaft 42; windings, if the rotor 40 carries windings; permanent magnets, if the rotor 40 carries the permanent magnets; and insulating material, mounting of the rotor shaft 42 stator 44 with windings, if the stator 44 carries windings; and insulating material, a housing part that, in the case of an integral motor, accommodates the rotor 40 and stator 44, but that, in the case of the rotor 40 and stator 44 being mounted separately, is not included in the weight of the electronically commutated electric motor 22.

It has been found that, owing to the size, weight and centre of gravity of the electric motors, a balanced hand-held power tool 10 is obtained only if, in the case of a nominal power of up to 600 W, the ratio of the weight of the electronically commutated electric motor 22 $M_{EKM}$ to the nominal power is between 0.4 g/W and 0.8 g/W. Ratios that exceed the value of 0.8 g/W are unfavorable in respect of the weight of the electronically commutated electric motor 22. This weight is then too great for the power range to which the hand-held power tool 10 belongs. Together with the weight of the electric motor, that of the hand-held power tool 10 also becomes too great. The hand-held power tool 10 thus becomes heavy, unwieldy and difficult to use. Since the motor housing 16 that accommodates the electronically commutated electric motor 22 forms the handle 24, the weight of the electronically commutated electric motor 22 lies in the operator's hand. The greater the weight of the electronically commutated electric motor 22, the heavier is the hand-held power tool 10 in the operator's hand. In this case, an optimum of the weight relative to the nominal power is also favorable in respect of ergonomic handling of the hand-held power tool 10. In the case of a nominal power of greater than 600 W, the optimum ratio of the weight of the electronically commutated electric motor 22 $M_{EKM}$ to the nominal power is between 0.15 g/W*$P_N$+150 g and 0.3 g/W*$P_N$+300 g.

A further ergonomically favorable design of the hand-held power tool 10 is achieved in that the ratio of a volume of the electronics system 30 to the volume of the electronically commutated electric motor 22 is optimized. The volume of the electronics system 30 is to be understood to mean a volume of a body that encloses all components of the electronics system 30. The electronics system 30 normally includes coils 46, capacitors 48 and power output stages 50. The volume of the body that accommodates the electronics system 30 corresponds to the structural space in the hand-held power tool 10. The volume of the electronically commutated electric motor 22 represents the volume of an envelope body that encloses the rotor packet 41 and a packet of the stator 44. The optimum ratio of the volume of the electronics system 30 to the volume of the electronically commutated electric motor 22 is at least 0.7, but maximally 1.6. This applies, in particular, if the hand-held power tool 10, in competitive comparison, in terms of its size and ergonomic characteristics, can provide only limited structural space.

In the case of ratios that are greater than 1.6, the volume of the electronics system 30 is too great as compared with the volume of the electronically commutated electric motor 22. The electronically commutated electric motor 22 would be too small relative to the electronics system 30, and could therefore only output a limited torque to the rotor shaft 42. This would result in a limited power being output to the spindle 26. In the case of ratios less than 0.7, the electronics system 30 would become to small for the electronically commutated electric motor 22, to supply sufficient electric current to the latter. This means that, for a given structural size, the hand-held power tool 10 would not be sufficiently powerful. Ratios of between 0.7 and 1.6 are optimal. The electronics system 30 is able to supply sufficient electric current/power to the electronically commutated electric motor 22, and the electronically commutated electric motor 22 is optimally dimensioned in relation to the electronics system 30.

The disclosure is based on the further knowledge that an optimum design of the volume of the electronically commutated electric motor 22 depends, not only on the volume of the electronics system 30, but also on a ratio of the volume of the electronically commutated electric motor 22 to the nominal power of the hand-held power tool 10. The ratio of the volume of the electronically commutated electric motor 22 to the nominal power of the hand-held power tool 10 should be maximally 100 $mm^3$/W. If the volume of the electronically commutated electric motor 22 is too great relative to the nominal power of the hand-held power tool 10, the required space that is occupied by the electronically commutated electric motor 22 in the hand -held power tool 10 becomes too large, and consequently the hand-held power tool 10 becomes too heavy and unwieldy. If the ratio is less than or equal to 100 $mm^3$/W, it is possible to shorten the length of the hand-held power tool 10. Here, likewise, the hand-held power tool 10 must withstand competition, such that it does not fail to meet expectations relating to the design of the hand-held power tool 10 in respect of the nominal power.

The efficiency at nominal power should be between 65% and 97%, but particularly between 65% and 90%. In order to achieve this efficiency, active cooling, for example, is effected, and an efficiency of a cooling system is matched to the efficiency at nominal power. In the case of active cooling, the thermal energy is removed from a component to be cooled, by means of the cooling system.

In the exemplary embodiment, the cooling system is a fan 52, which is mounted on the rotor shaft 42. The fan 52 rotates as the rotor shaft 42 rotates, and generates an air flow. It is also conceivable, however, for the fan 52 to be driven by a separate actuator. Furthermore, it is conceivable for other cooling systems to be used, such as Peltier elements, piezo-vanes, piezo-pumps and closed cooling circuits. The cooling relates to the hand-held power tool 10, and includes components such as the motor housing 16, transmission housing 18, transmission 20, electronically commutated electric motor 22, and electronics system 30, i.e. these components are actively cooled.

An optimum design of the cooling is ensured in that a cooling capacity $P_K$ is a fraction of the nominal power $P_N$. In this case, $P_K$=k*$P_N$, wherein k is less than 0.1, but in particular is less than 0.075 (FIG. 4).

Figure 4:
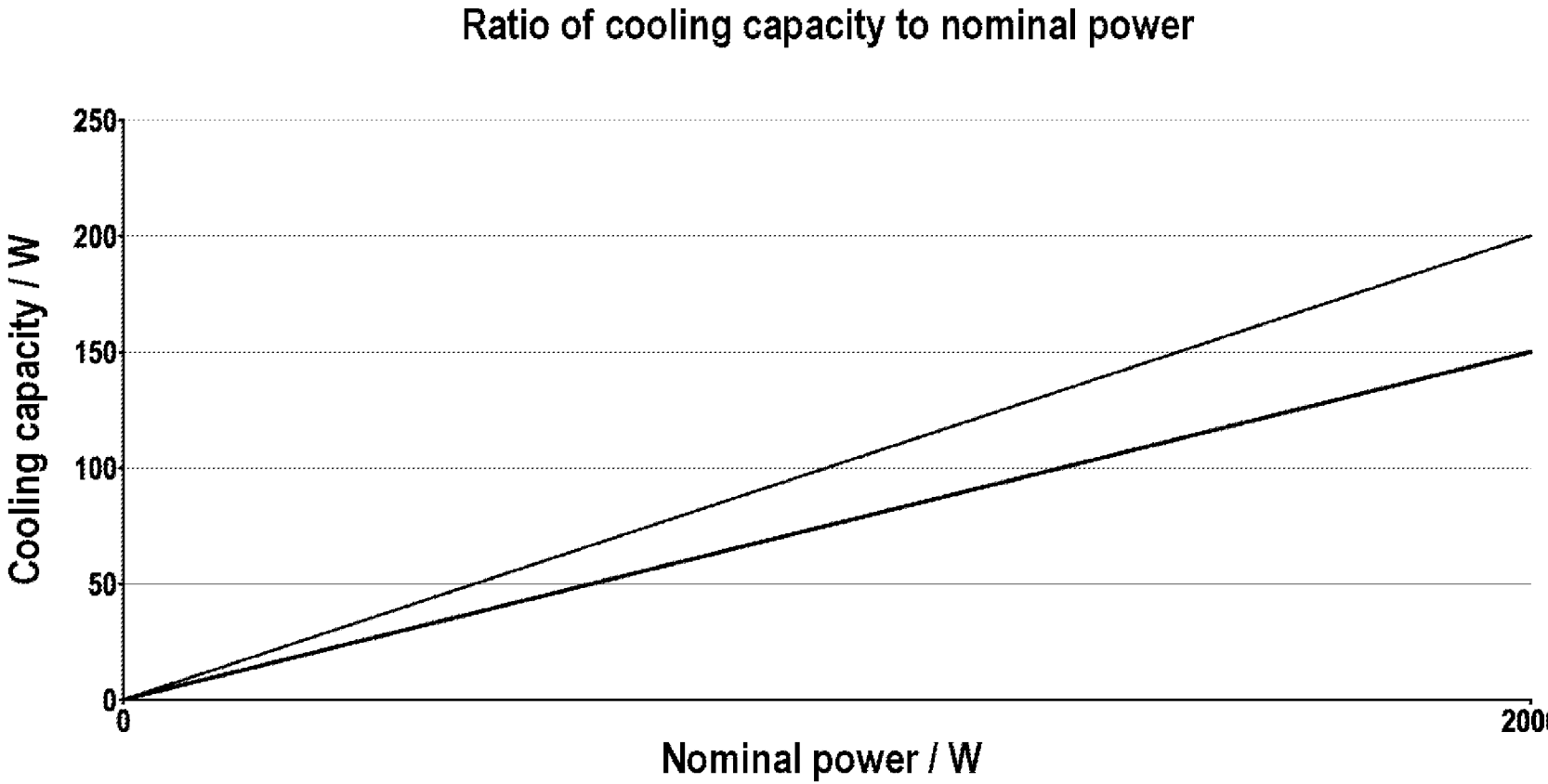

In FIG. 4, the cooling capacity is represented over the nominal power. The design is particularly advantageous if the cooling capacity is equal to or less than 7.5% of the nominal power, but maximally does not exceed 10% of the nominal power $P_N$. If the nominal power $P_N$ of a hand-held power tool is, for example, 1000 W, the value of the cooling capacity is advantageously equal to or less than 75 W, by maximally 100 w. The cooling capacity in this case is the power of the respectively used cooling system. Generally, it can be determined in that the power of the hand-held power tool 10 is measured once without and once with a cooling system. The difference of the two ascertained powers is the cooling capacity. If a fan 52 mounted on the rotor shaft 42 is used, the cooling capacity results from the torque acting on the rotor shaft 42 and from the rotational speed at which the fan rotates. If a Peltier element is used, the cooling capacity is normally the electrical power of the component, and is determined from the product of current and voltage.

Figure 5:
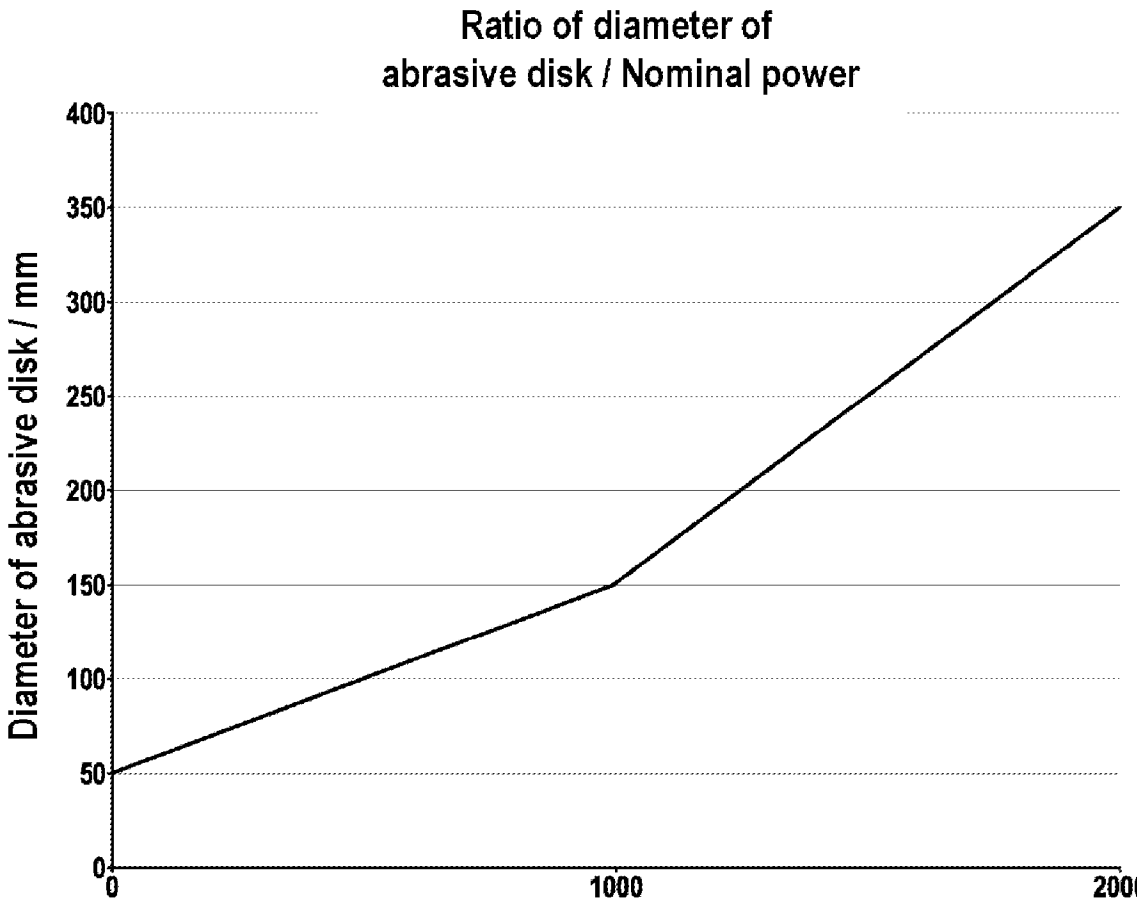

In the case of a nominal power of up to 1000 W, the ratio of a diameter $d_{Disk}$ of the working tool 28, in particular of an abrasive and/or cutting disk, to the nominal power $P_N$ (FIG. 5) should be maximally 0.09 mm/W*$P_N$55 mm. In FIG. 5, the diameter of the working tool 28 is represented over the nominal power. If the nominal power is greater than 1000 W, the optimum ratio of the diameter $d_{Disk}$ of the abrasive and/or cutting disk to the nominal power $P_N$ of the hand-held power tool 10 is maximally 0.2 mm/W*$P_N$−60 mm. If the ratio of the diameter $d_{Disk}$ of the abrasive and/or cutting disk to the nominal power is greater than 0.2 mm/W*$P_N$−60 mm, there is a risk of the electronics system 30 reaching its power limit and overheating. Normally, if the electronics system 30 overheats, the electronics system 30 is limited automatically. In this case, the operator of the hand-held power tool 10 is restricted in that he must wait until the electronics system 30 has cooled down and the hand-held power tool 10 can be switched on again. However, if the ratio of the diameter $d_{Disk}$ of the abrasive and/or cutting disk to the nominal power is not greater than 0.2 mm/W*$P_N$−60 mm, overheating of the electronics system is not likely. Automatic switch-off is therefore not necessary, and the operator can operate the hand-held power tool 10 without restriction for as long as the application requires.

Figure 6:
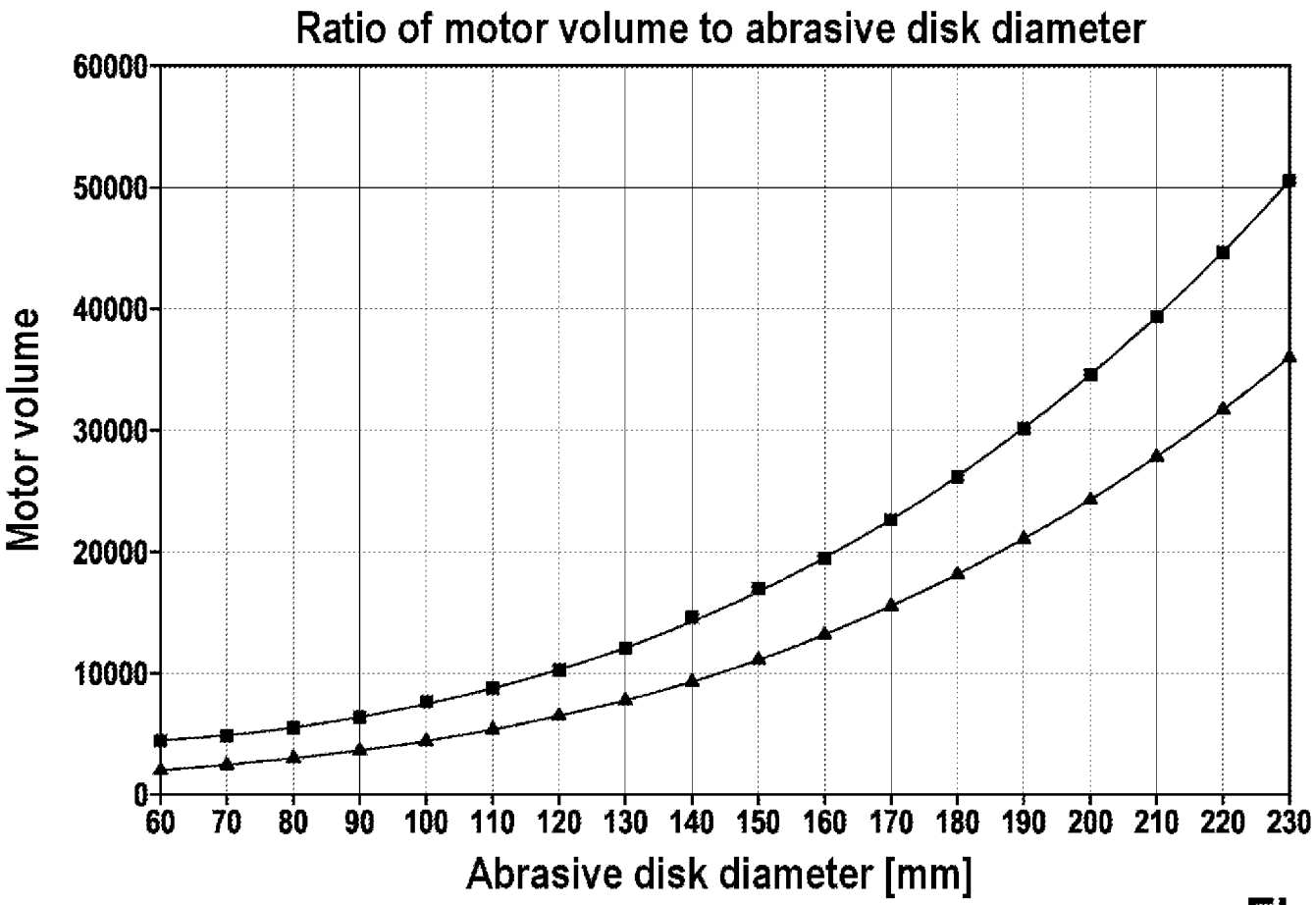

A further aspect in respect of optimum design of the hand-held power tool 10 consists in a ratio of a diameter of the electronically commutated electric motor 22 $d_{Motor}$ to the diameter of the abrasive disk $d_{Disk}$, as shown in FIG. 6. Optimally, the diameter $d_{Motor}$ of the electronically commutated electric motor 22≤0.27*$d_{Disk}$+10, but maximally 0.37*$d_{Disk}$+5.

Figure 7:
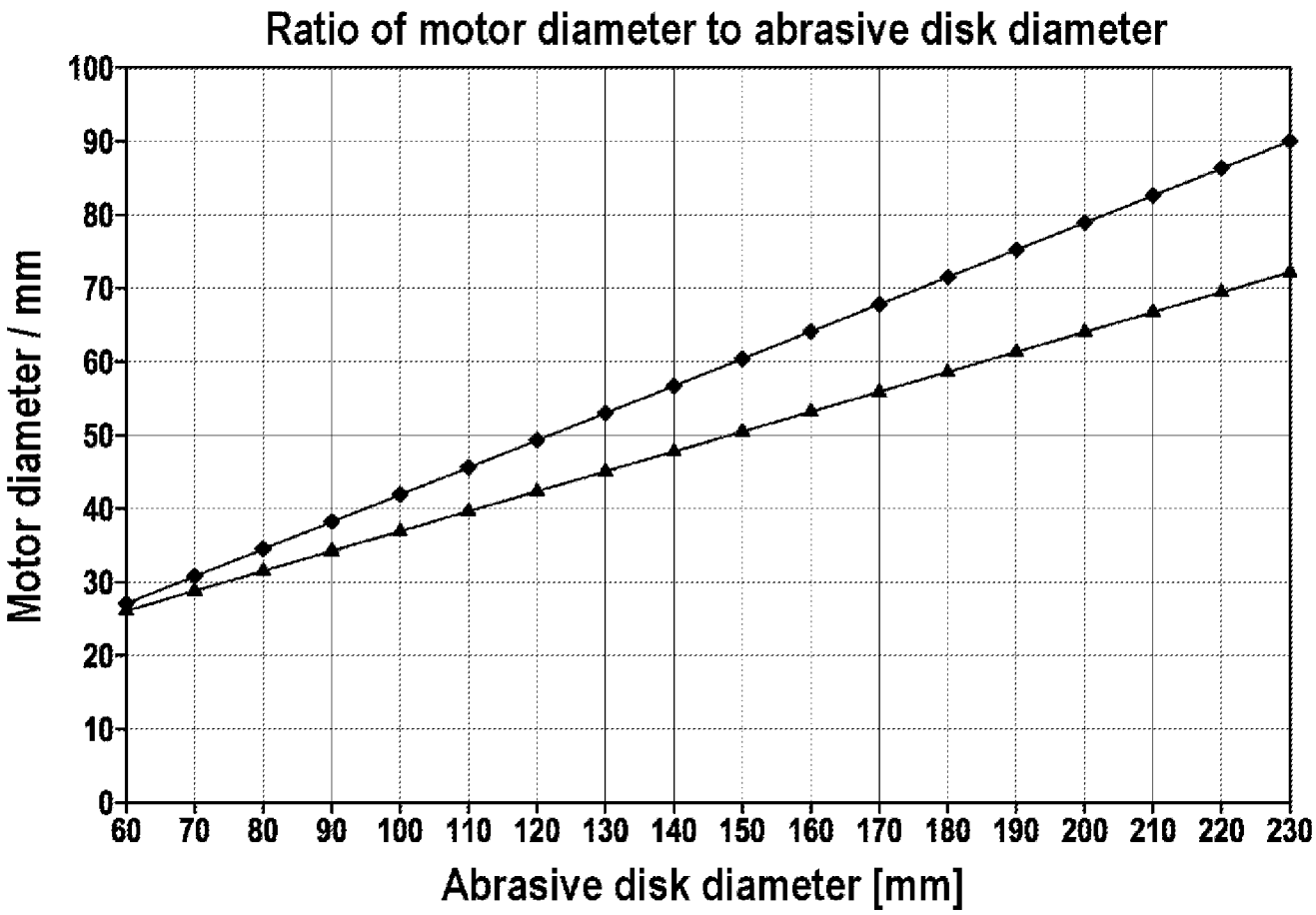

FIG. 7 shows a further optimum design of the hand-held power tool 10. The volume of the electronically commutated electric motor 22 $V_{Motor}$ is optimally $V_{Motor}$≤0.014*$d_{Disk}^3$+7500. The volume of the electronically commutated electric motor (22) $V_{Motor}$ should be maximally 0.019*$d_{Disk}^3$+18000.

Figure 8:
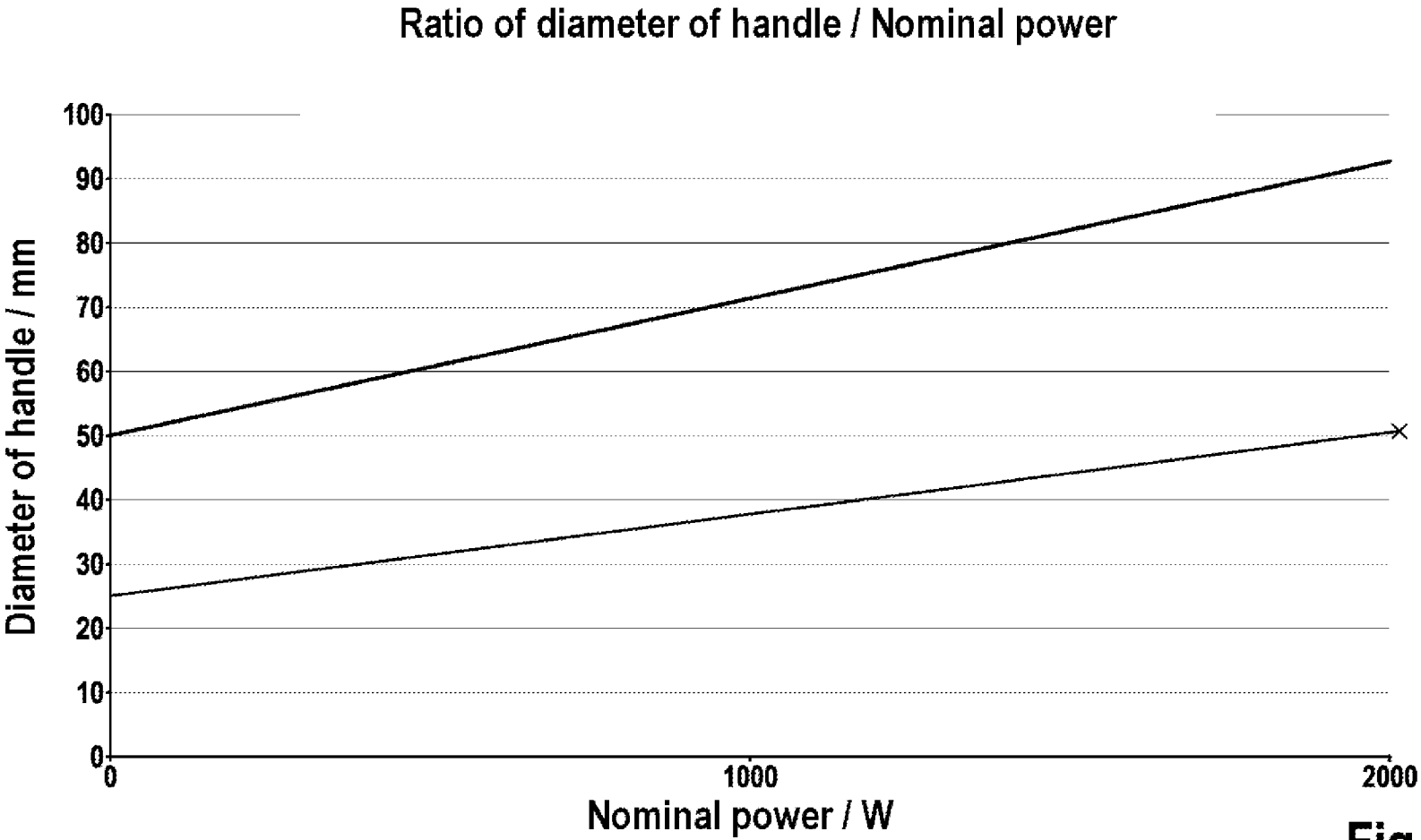

As shown in FIG. 8, a further optimum design in respect of handling of the hand-held power tool 10 is achieved in that a diameter of the handle 24 is at least 0.0125 mm/W*$P_N$+25 mm, but maximally is 0.0215 mm/W*$P_N$+50 mm. In FIG. 6, the diameter of the handle 24 is represented over the nominal power. Since the motor housing 16 is realized as a handle 24, the diameter of the handle 24 correlates with a diameter of the electronically commutated electric motor 22. If the diameter of the electronically commutated electric motor 22 is too small in the case of a corresponding power, the hand-held power tool 10 becomes too long, and therefore too unwieldy. If the diameter of the electronically commutated electric motor 22 is too great in the case of a corresponding power, the hand-held power tool 10 becomes too large in a diameter, and can no longer be held in an optimum manner.

In the exemplary embodiment, the electronically commutated electric motor 22 is a brushless moor. The brushless motor does not have any commutator or any carbon brushes for current reversal. In the exemplary embodiment, the commutation of the brushless motor is effected without sensors. In the case of commutation without sensors, the sensing of a position of the rotor 40 is effected by means of a counter-voltage triggered in the coils of the stator 44. The counter-voltage is evaluated by the electronics system 30. It is also conceivable, however, for the commutation of the brushless motor to be effected by means of a sensor or a plurality of sensors. The sensor/sensors senses/sense a magnetic flux, and therefore the position of the rotor 40. Depending on the position of the rotor 40, the power output stages 56 excite the coils of the stator 44, which, in turn, generate a torque in the rotor 40.

In the exemplary embodiment, the hand-held power tool 10 is provided with a mains power connection line 38. The mains power connection line 38 leads, via a grommet 54, into the interior of the hand-held power tool 10, to the electronics system 30 and a power supply unit belonging to the electronics system 30. It is also conceivable, however, for the hand-held power tool 10 to be realized without a mains power connection line, as is the case with battery operated hand-held power tools 10. In that case, a battery performs the function of supplying energy to the hand-held power tool 10, and supplies the electronics system 30. In this case, the battery may be understood to be a part of the electronics system 30.

The motor housing 16 has a shape other than that of a cylinder. This means that the moor housing 16 may be oval, hexagonal or octagonal. However, any other shape is also conceivable. It is equally conceivable for the motor housing 16 to have a cylindrical shape. In the case of a hexagonal or octagonal shape, cables and inner wiring, for example, can be routed through the hand-held power tool 10 in a particularly effective manner, owing to the fact that, for given round dimensions of the electronically commutated electric motor 22, the volume of the motor housing 16 is greater than in the case of a cylindrical shape. An oval shape offers a particular saving of space, as does a cylindrical shape. Although it does require effective routing of wiring, an oval or cylindrical motor housing 16 nevertheless can be held comfortably by the operator, and enables savings in material.

In the exemplary embodiment, the switching element 34 is a mechanical switch. It is also conceivable, however, for the switching element 34 to be realized by a microswitch.

The hand-held power tool 10 is realized as an angle grinder. Angle grinders are hand-held power tools 10 for grinding and cutting metals and similar materials. It is also conceivable, however, for the hand-held power tool 10 to be realized as an orbital sander, cup-wheel grinder, polisher, concrete grinder or router.

The invention claimed is:

1. A hand-held power tool having a drive unit, comprising:

an electronically commutated electric motor; and an electronics system integrated in an appliance housing, wherein:

a ratio of a weight of the hand-held power tool to a nominal power $P_N$ is selected such that:

when the nominal power has a value in a range of 0 to 1200 W, the ratio of the weight of the hand-held power tool to the nominal power $P_N$ is maximally 0.75 g/W * $P_N$+1200 g, and when the nominal power has a value greater than 1200 W, the ratio of the weight of the hand-held power tool to the nominal power $P_N$ is maximally 2.2*$P_N$−540 g.

2. The hand-held power tool as claimed in claim 1, wherein, when the nominal power has a value in a range of 0 to 600 W, a ratio of a weight of the electronically commutated electric motor to the nominal power $P_N$ is less than 0.8 g/W.

3. The hand-held power tool as claimed in claim 1, wherein, when the nominal power has a value greater than 600 W, a ratio of a weight of the electronically commutated electric motor to the nominal power $P_N$ is less than 0.3 g/W*$P_N$+300 g.

4. The hand-held power tool as claimed in claim 1, wherein a ratio of a volume of the electronics system to a volume of the electronically commutated electric motor is greater than or equal to 0.7 and less than or equal to 1.6.

5. The hand-held power tool as claimed in claim 1, wherein a ratio of a volume of the electronically commutated electric motor to the nominal power is less than or equal to 100 $mm^3/W$.

6. The hand-held power tool as claimed in claim 4, wherein the volume of the electronically commutated electric motor represents a volume of an envelope body that encloses a rotor and a stator.

7. The hand-held power tool as claimed in claim 1, wherein a value of an efficiency is between 65% and 97%.

8. The hand-held power tool as claimed in claim 1, wherein a cooling capacity $P_K$ is a fraction of the nominal power $P_N$, such that $P_K=k*P_N$, wherein k is less than 0.1.

9. The hand-held power tool as claimed in claim 1, wherein, when the nominal power has a value in a range of 0 to 1000 W, a ratio of a diameter of an abrasive disk $d_{Disk}$ to the nominal power $P_N$ is less than or equal to 0.09 $mm/W*P_N+55$ mm.

10. The hand-held power tool as claimed in claim 9, wherein a diameter of the electronically commutated electric motor is less than or equal to $0.27*d_{Disk}+10$.

11. The hand-held power tool as claimed in claim 9, wherein a diameter of the electronically commutated electric motor is less than or equal to $0.37*d_{Disk}+5$.

12. The hand-held power tool as claimed in claim 9, wherein a volume of the electronically commutated electric motor less than or equal to $0.014*d_{Disk}^3+7500$.

13. The hand-held power tool as claimed in claim 9, wherein a volume of the electronically commutated electric motor is less than or equal to $0.019*d_{Disk}^3+18000$.

14. The hand-held power tool as claimed in claim 9, wherein, when the nominal power has a value greater than 1000 W, the ratio of the diameter of the abrasive disk to the nominal power $P_N$ is less than or equal to $0.2\ mm/W*P_N-60$ mm.

15. The hand-held power tool as claimed in claim 1, wherein a diameter of a handle is greater than or equal to $0.125\ mm/W*P_N+25$ mm.

16. The hand-held power tool as claimed in claim 15, wherein the diameter of the handle is less than or equal to $0.0215\ mm/W*P_N+50$ mm.

17. The hand-held power tool as claimed in claim 1, wherein the electronically commutated electric motor is a brushless motor.

18. The hand-held power tool as claimed in claim 1, further comprising a mains power connection line.

19. The hand-held power tool as claimed in claim 1, wherein the appliance housing has a shape other than a cylinder.

20. The hand-held power tool as claimed in claim 1, wherein the hand-held power tool is an angle grinder.

* * * * *